US008333275B2

(12) United States Patent
McFarlane et al.

(10) Patent No.: US 8,333,275 B2
(45) Date of Patent: Dec. 18, 2012

(54) PORTABLE JAR HOLDER

(75) Inventors: Jeri A. McFarlane, Riverton, WY (US); Robert J. Wright, Riverton, WY (US); Patrick M. Thayer, Riverton, WY (US)

(73) Assignee: Store-it-More, LLC, Riverton, WY (US)

( * ) Notice: Subject to any disclaimer, the term of this patent is extended or adjusted under 35 U.S.C. 154(b) by 128 days.

(21) Appl. No.: 13/013,313

(22) Filed: Jan. 25, 2011

(65) Prior Publication Data

US 2012/0187016 A1 Jul. 26, 2012

(51) Int. Cl.
*B65D 71/00* (2006.01)
*B65D 71/70* (2006.01)

(52) U.S. Cl. ..... 206/144; 206/509; 206/511; 206/562; 206/427; 220/518; 220/519; 220/DIG. 2; 220/DIG. 15

(58) Field of Classification Search ..... 206/514, 206/509, 504, 518, 511, 515, 427, 485, 485.1, 206/139, 140, 144, 446, 562–564, 557, 419; 220/509, DIG. 2, DIG. 15
See application file for complete search history.

(56) References Cited

U.S. PATENT DOCUMENTS

| | | | | |
|---|---|---|---|---|
| 2,738,891 | A | 3/1956 | Pitto | |
| 2,878,932 | A * | 3/1959 | Martire, Jr. | 206/564 |
| 3,191,791 | A * | 6/1965 | Jackson | 217/25.5 |
| 5,184,748 | A | 2/1993 | Apps | |
| 5,230,601 | A | 7/1993 | Apps et al. | |
| 5,377,862 | A | 1/1995 | Oakes et al. | |
| 5,634,559 | A * | 6/1997 | Foos et al. | 206/518 |
| 7,721,891 | B2 | 5/2010 | Dubois | |
| 2007/0034540 | A1 | 2/2007 | Dubois | |
| 2007/0246392 | A1 | 10/2007 | Stahl | |
| 2009/0108002 | A1 | 4/2009 | Delbrouck et al. | |
| 2009/0178946 | A1 | 7/2009 | Patstone et al. | |

FOREIGN PATENT DOCUMENTS

| | | | |
|---|---|---|---|
| WO | WO 92/12055 | * | 7/1992 |

* cited by examiner

*Primary Examiner* — J. Gregory Pickett
*Assistant Examiner* — Mollie Llewellyn
(74) *Attorney, Agent, or Firm* — Antoinette M. Tease

(57) ABSTRACT

A tray for holding canning jars comprising a plurality of wells arranged in a first row, second row and third row, each well comprising a bottom surface with ridges. The ridges in the first and third rows comprise an inner circle, two first opposing crescents, and two second opposing crescents. The ridges in the second row comprise a first semicircle and a second semicircle. The two first opposing crescents are situated opposite one another, and the two second opposing crescents are situated opposite one another on the bottom of the well and at a ninety-degree angle relative to the first opposing crescents. The first semicircle is situated opposite the second semicircle and is closer to the center of the bottom surface of the well than the second semicircle.

14 Claims, 12 Drawing Sheets

PORTABLE JAR HOLDER

BACKGROUND OF THE INVENTION

1. Field of the Invention

The present invention relates generally to the field of portable containers, and, more specifically, to a portable container for holding canning jars in a number of different configurations.

2. Description of the Related Art

Prior art includes stackable jars (U.S. Pat. No. 2,738,891), nestable trays (U.S. Pat. No. 5,184,748), and a method for locking a first stack of trays onto a second stack of trays involving protruberances on the bottom floor surfaces of each tray (U.S. Pat. No. 5,230,601). U.S. Pat. No. 5,377,862 describes a bottle holder and bottle holding system in which a pair of identical thermoformed bottle holders support the bases and to portions of an array of glass bottles. U.S. Pat. No. 7,721,891 provides a system of nested and stacked containers that are not specifically designed to hold jars.

U.S. Pat. No. 7,743,939 discloses a nestable beverage case in which the lower wall section is inset relative to the upper wall section so that one case can nest into another up to about one-half its height. U.S. Patent Application Pub. No. 2009/0108002-provides a stackable tray assembly in which beverage multipacks or individual bottles may be inserted in between individual trays. U.S. Patent Application Pub. No. 2009/0178946 describes a container assembly for the storage and transport of goods in which a second portion is pivotally connected to a first portion. Both the first and second portions have an outer surface with a stacking pattern on it that allows one container assembly to be stacked on top of another.

There is no product on the market today that holds up to six or twelve (depending on the embodiment) canning jars, is portable and stackable in the number of different configurations described herein, and that accommodates both standard and wide-mouth canning jars. None of the inventions mentioned above is specifically designed to accommodate both standard and wide-mouth canning jars, to "locate" each individual jar within the assembly, to "locate" tops of jars to bottom of trays, and to allow each tray to serve either as a cover or as a base. In short, the trays of the present invention are designed to locate, stack, snap and nest. The structural features of the present invention are discussed more fully below in connection with the figures.

BRIEF SUMMARY OF THE INVENTION

The present invention is a tray for holding canning jars comprising a plurality of wells arranged in a first row, a second row and a third row, each well comprising a bottom surface with ridges; wherein the ridges on the bottom surface of each well in the first and third rows comprise an inner circle, two first opposing crescents that lie outside of the inner circle, and two second opposing crescents, and the ridges on the bottom surface of each well in the second row comprise a first semicircle and a second semicircle; wherein the inner circle is situated at the center of the bottom surface of each well, the two first opposing crescents are situated opposite one another on the bottom surface of the well, the two second opposing crescents are situated opposite one another on the bottom of the well and at a ninety-degree angle relative to the first opposing crescents, and the two first opposing crescents are closer to the inner circle than the two second opposing crescents; and wherein the bottom surface of each well has a center, the first semicircle on the bottom surface of the wells in the second row is situated opposite the second semicircle, and the first semicircle is closer to the center of the bottom surface of the well than the second semicircle.

In a preferred embodiment, each canning jar comprises a lid with an outer ring having an inside diameter, and the outside diameter of the first opposing crescents is roughly the same as the inside diameter of the outer ring of a standard canning jar. Preferably, each canning jar comprises a lid with an outer ring having an inside diameter, and the outside diameter of the second opposing crescents is roughly the same as inside diameter of the outer ring of a wide-mouth calming jar.

In a preferred embodiment, each canning jar comprises a lid with an outer ring having an inside diameter, each inner circle has an outside diameter, and the outside diameter of each of the inner circles is less than the inside diameter of the outer ring on the lid of a standard canning jar. Preferably, each canning jar comprises a lid with an outer ring having an inside diameter, each of the first semicircles has an outside diameter, and the outside diameter of the first semicircles is roughly the same as the inside diameter of the outer ring on the lid of a standard canning jar. Preferably, each canning jar comprises a lid with an outer ring having an inside diameter, each of the second semicircles has an outside diameter, and the outside diameter of the second semicircles is roughly the same as the inside diameter of the outer ring on the lid of a wide-mouth canning jar.

In a preferred embodiment, the first and third rows each comprises a first well and a second well, the inner circle on the bottom surface of the second well in the first row is slightly smaller than the inner circle on the bottom surface of the first well in the first row, and the inner circle on the bottom surface of the first well in the third row is slightly smaller than the inner circle on the bottom surface of the second well in the third row. In an alternate embodiment, the first and third rows each comprises a first well, a second well, a third well, and a fourth well, the inner circle on the bottom surface of the second and fourth wells in the first row is slightly smaller than the inner circle on the bottom surface of the first and third wells in the first row, and the inner circle on the bottom surface of the first and third wells in the third row is slightly smaller than the inner circle on the bottom surface of the second and fourth wells in the third row.

In a preferred embodiment, the second well in the first row is rotated ninety degrees relative to the first well in the first row, and the second well in the third row is rotated ninety degrees relative to the first well in the third row and relative to the second well in the first row. In an alternate embodiment, the second and fourth wells in the first row are rotated ninety degrees relative to the first and third wells in the first row, and the second and fourth wells in the third row are rotated ninety degrees relative to the first and third wells in the third row and relative to the second and fourth wells in the first row.

In a preferred embodiment, the second row comprises a first well and a second well, and wherein the second well in the second row is rotated one hundred eighty degrees relative to the first well in the second row. In an alternate embodiment, the second row comprises a first well, a second well, a third well, and a fourth well, and wherein the second and fourth wells in the second row are rotated one hundred eighty degrees relative to the first and third wells in the second row.

In a preferred embodiment, the invention further comprises a top surface and a perimeter, a number of tongues extend partially around the perimeter of the tray, the same number of grooves extend partially around the perimeter of the tray, and the tongues and grooves are situated such that each tongue on one tray fits within a groove on another tray when the top surface of one tray abuts up against the top surface of another tray. Preferably, the top surface comprises at least one snap mechanism comprised of an upward protrusion and a downward protrusion on the top surface of the tray, and the upward and downward protrusions are situated such that the upward protrusion on one tray fits within a downward protrusion on another tray when the top surface of one tray abuts up against the top surface of another tray.

REFERENCE NUMBERS

1 Tray
2 Well
3 Standard canning jar
3*a* Standard canning jar outer ring (of lid)
3*b* Standard canning jar inner disc (of lid)
4 Wide-mouth canning jar
4*a* Wide-mouth canning jar outer ring (of lid)
4*b* Wide-mouth canning jar inner disc (of lid)
5 Top surface (of tray)
6 Perimeter (of top surface of tray)
7 Tongue
8 Groove
9 Snap mechanism
9*a* Upward protrusion (of snap mechanism)
9*b* Downward protrusion (of snap mechanism)
10 Aperture
11 Indentation
12 Side wall
13 Ridges
13*a* Inner circle
13*b* First opposing crescents
13*c* Second opposing crescents
13*d* First semicircle
13*e* Second semicircle

DETAILED DESCRIPTION OF INVENTION

Figure 1:
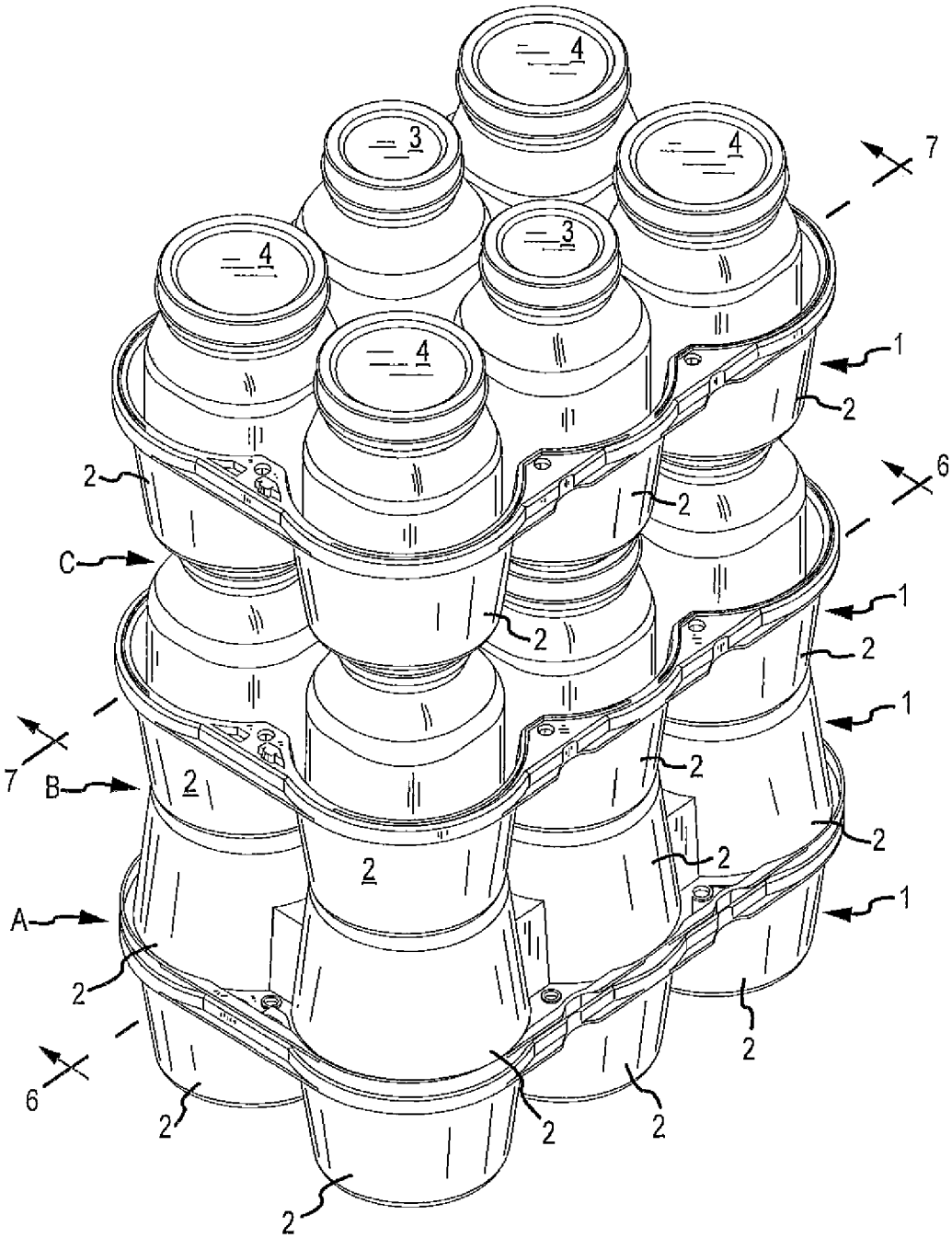
FIG. 1 is a perspective view of a first embodiment of the present invention.

FIG. 1 is a perspective view of a first embodiment of the present invention. This embodiment comprises one or more stackable trays 1, each of which comprises six wells 2 for holding a standard 3 or wide-mouth 4 canning jar. As shown in this figure, the trays 1 are structured so that they can be stacked top to top ("A" on FIG. 1), bottom to bottom ("B" on FIG. 1), or top of jar to bottom of tray ("C" on FIG. 1). Each of these stacking configurations is described more fully below.

Figure 2:
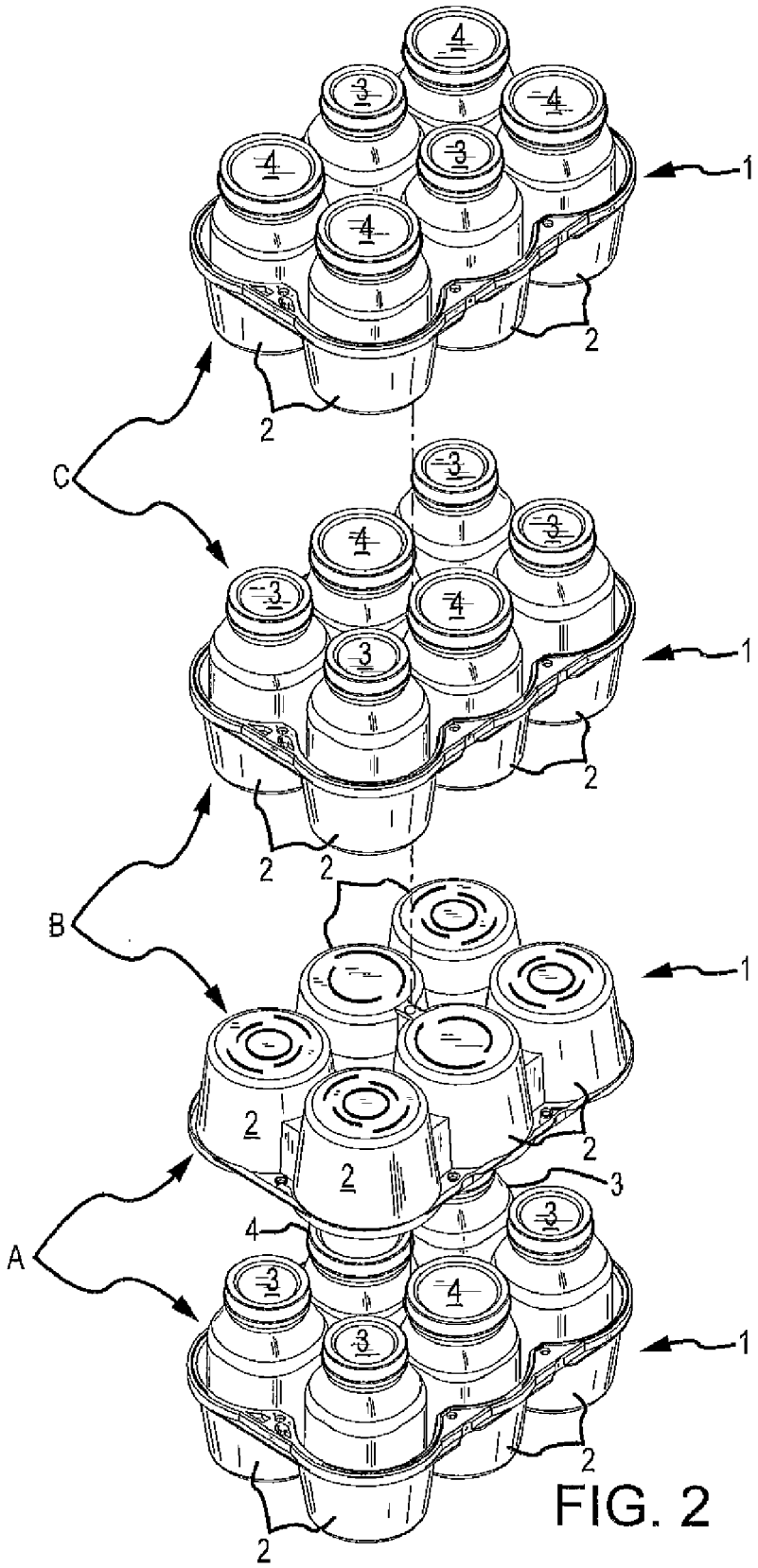
FIG. 2 is an exploded perspective view of a first embodiment of the present invention.
Figure 3:
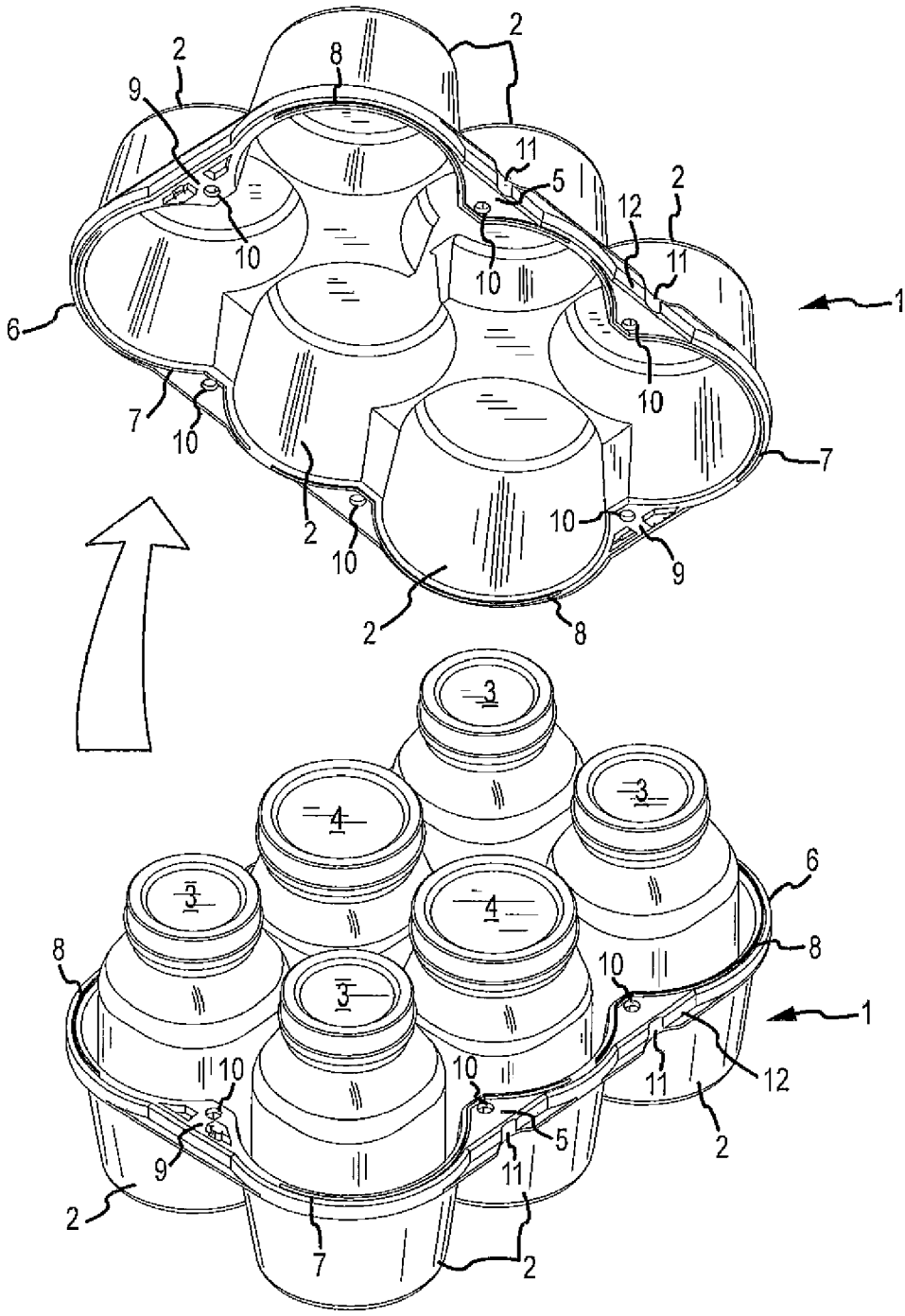
FIG. 3 is a perspective view of one stacking tray serving as a base and another stacking tray serving as a top cover.

FIG. 2 is an exploded perspective view of a first embodiment of the present invention. This figure further illustrates the top-to-top configuration ("A" on FIG. 2), bottom-to-bottom configuration ("B" on FIG. 2), and top-of-jar-to-bottom-of-tray configuration ("C" on FIG. 2). In the top-to-top configuration, shown more specifically in FIG. 3, one stacking tray serves as a base for holding the jars 3, 4, and another identical stacking tray serves as a top cover. Each tray has a top surface 5 with a perimeter 6. Around the perimeter are a series of tongues 7 and grooves 8. When the top surface 5 of one tray 1 is placed against the top surface 5 of another tray 1 such that their respective perimeters 6 are aligned, the tongues 7 on one of the trays fit into the grooves 8 on the other tray, thereby securing one tray as a top cover for the other. In addition, a snap mechanism 9 (further illustrated in FIGS. 5 and 6) fastens the two trays together when in the top-to-top configuration.

In a preferred embodiment, the top surface 5 of each tray 1 further comprises apertures 10 situated around the perimeter 6 of the top surface of the tray and between the jars, and the side walls 12 of the trays 1 comprise indentations 11 adjacent to the apertures 10 (except for those apertures 10 situated next to the snap mechanism 9), so that a string, rope or cable may be passed through the apertures 10 and used to secure the trays together when stacked in any of the configurations shown in FIGS. 1 and 2 or to secure the trays to another surface, such as a wall, truck bed, cabinet, etc.

Figure 4:
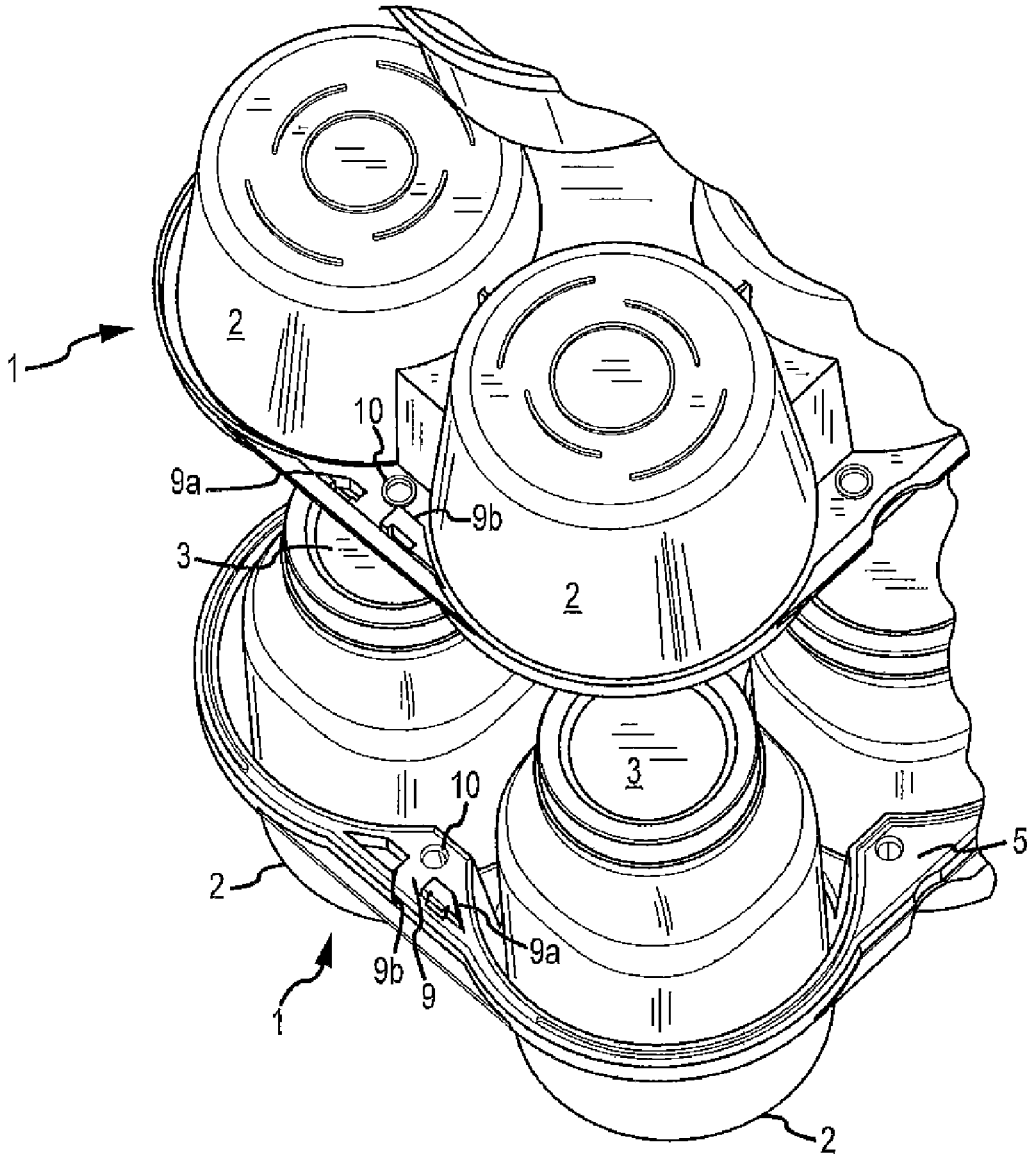
FIG. 4 is a cutaway perspective view of the snap mechanism on the base and top cover.
Figure 5:
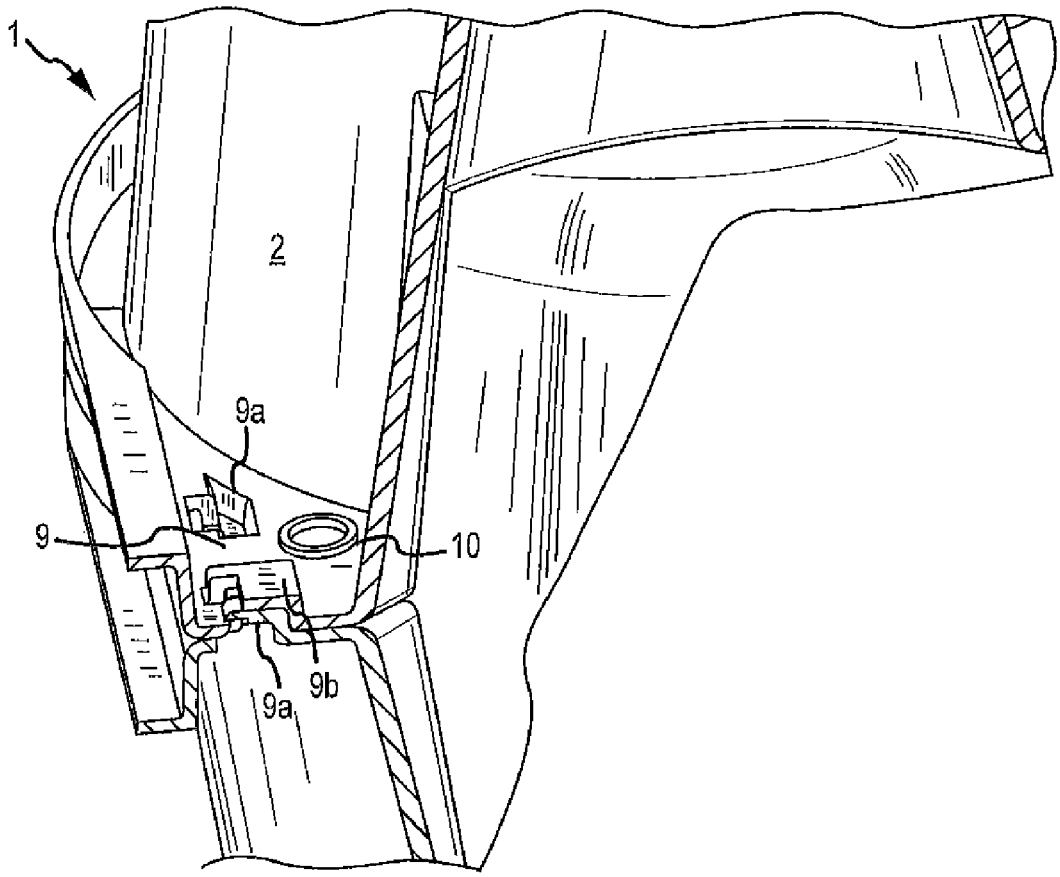
FIG. 5 is a section view of the snap mechanism of the present invention.

As shown in FIG. 4, the snap mechanism 9 comprises two oppositely oriented protrusions 9*a*, 9*b* adjacent to each other and located on opposite ends of the perimeter 6 of the top surface 5 of each tray 1. One protrusion 9*a* protrudes upward from the top surface 5 of the tray, and the other protrusion 9*b* protrudes downward from the top surface 5 of the tray. The two protrusions 9*a*, 9*b* are shaped and sized so that when the trays are aligned top to top, as shown in FIG. 4, protrusion 9*a* fits into protrusion 9*b*, thereby snapping the top cover tray into place on the base tray. Each tray is preferably rectangularly shaped, with two long sides and two short sides. The snap mechanisms 9 are preferably located in the center of each short side of each rectangular tray. FIG. 5 is a section view of the snap mechanism 9.

Figure 6:
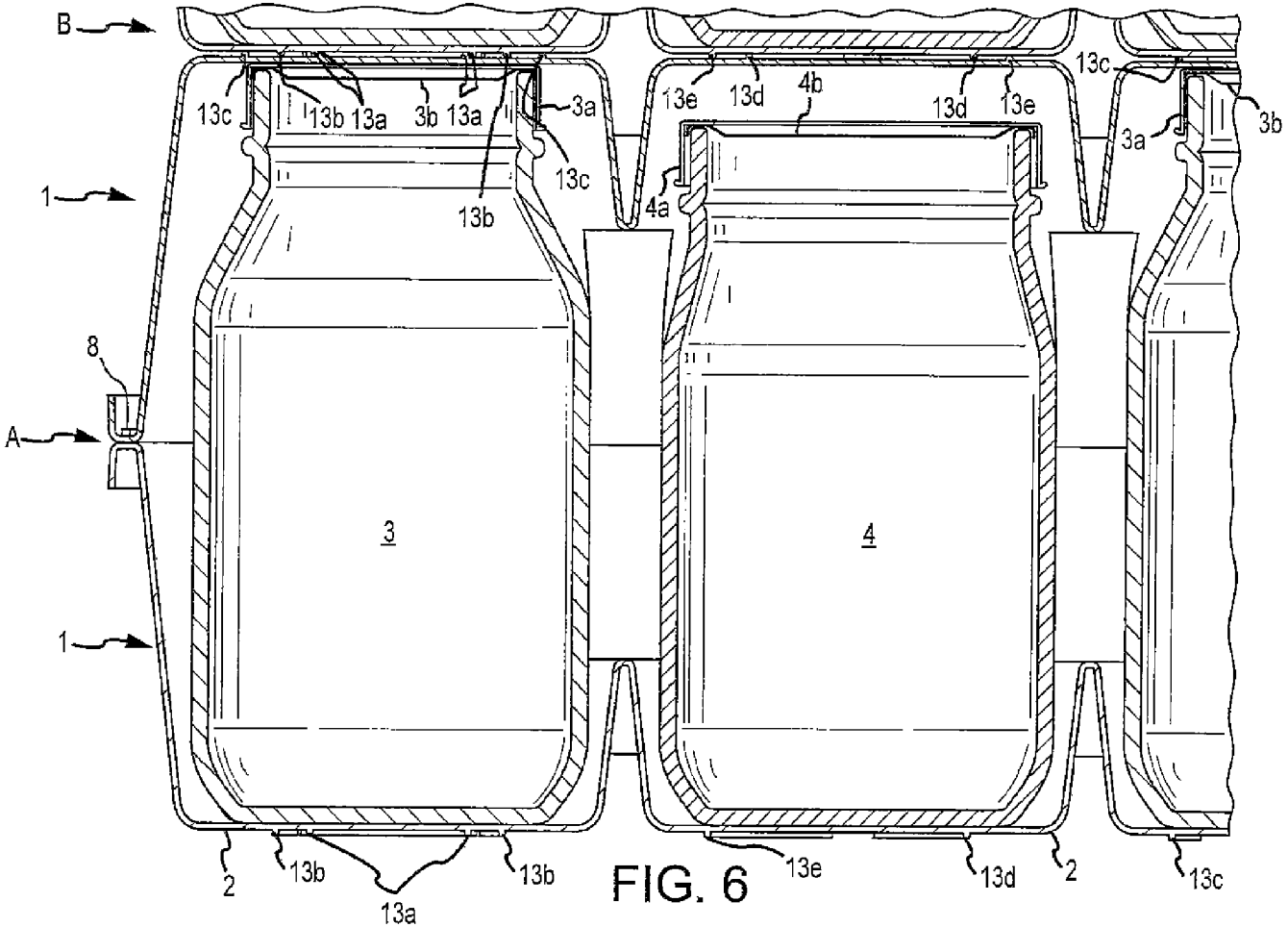
FIG. 6 is a first section view of the embodiment shown in FIG. 1.

FIG. 6 is a first section view of the embodiment shown in FIG. 1. This figure illustrates the top-to-top ("A" in FIG. 6) and bottom-to-bottom ("B" in FIG. 6) configurations of the present invention. In the bottom-to-bottom configuration, ridges 13 on the bottom of each well 2 are configured so that they do not overlap when the bottoms of the wells abut up against each other; the configuration of the ridges 13 is shown more clearly in FIG. 9. (The ridges 13 protrude downward from the bottom of each well 2.) The ridges 13 are also configured to secure the of a standard 3 or wide-mouth 4 canning jar, as explained more fully in connection with FIG. 9. Note that each canning jar lid comprises an outer ring 3*a*, 4*a* and an inner disc 3*b*, 4*b*. FIG. 6 shows that the ordinary wide-mouth canning jar 4 will not normally extend the full height of two trays 1; however, the depth of each tray 1 is preferably approximately one-half that of a standard canning jar 3, as shown.

Figure 7:
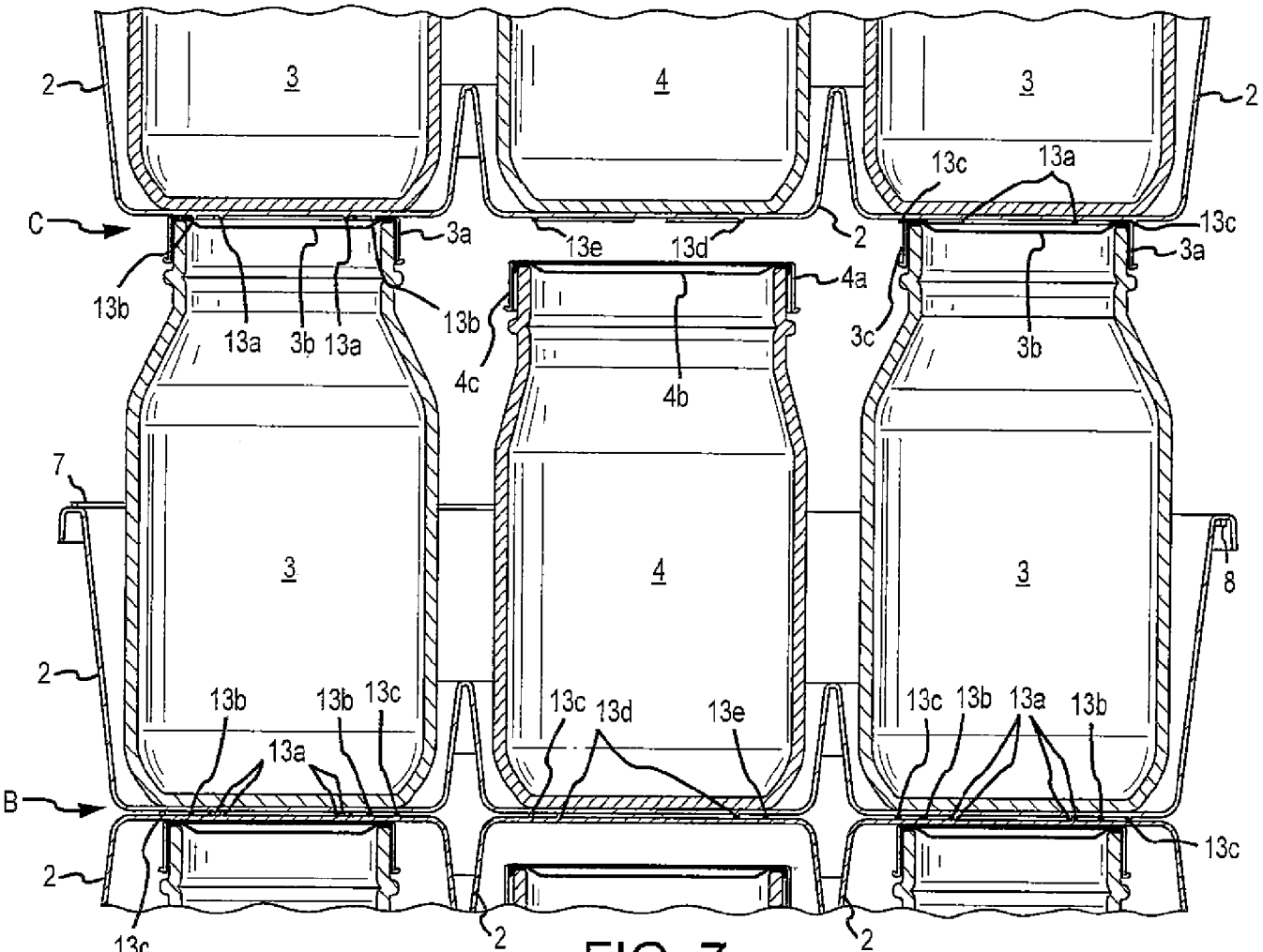
FIG. 7 is a second section view of the embodiment shown in FIG. 1.

FIG. 7 is a second section view of the embodiment shown in FIG. 1. This figure shows more clearly the bottom to bottom configuration ("B" in FIG. 7) and the top-of-jar-to-bottom-of-tray configuration ("C" in FIG. 7). The ridges 13 on the bottoms of each well 2 are configured so that they can hold either a standard canning jar 3 or a wide-mouth canning jar 4; however, as shown in this figure, because the wide-mouth canning jar 4 is typically, shorter than the standard canning jar 3, the lid on the wide-mouth canning jar 4 will not typically come into contact with the ridges 13 on the bottom of the wells 2 if there are also standard canning jars 3 in the same tray 1.

Note that the present invention is not limited to any particular configuration and that multiple configurations may be used in the same assembly; for example, as shown in FIGS. 1 and 2, the same assembly of trays may have a top-to-top, bottom-to-bottom and top-of-jar-to-bottom-of-tray configuration. It is also important to note that either a standard 3 or a wide-mouth 4 canning jar may be placed in any of the wells 2.

Figure 7A:
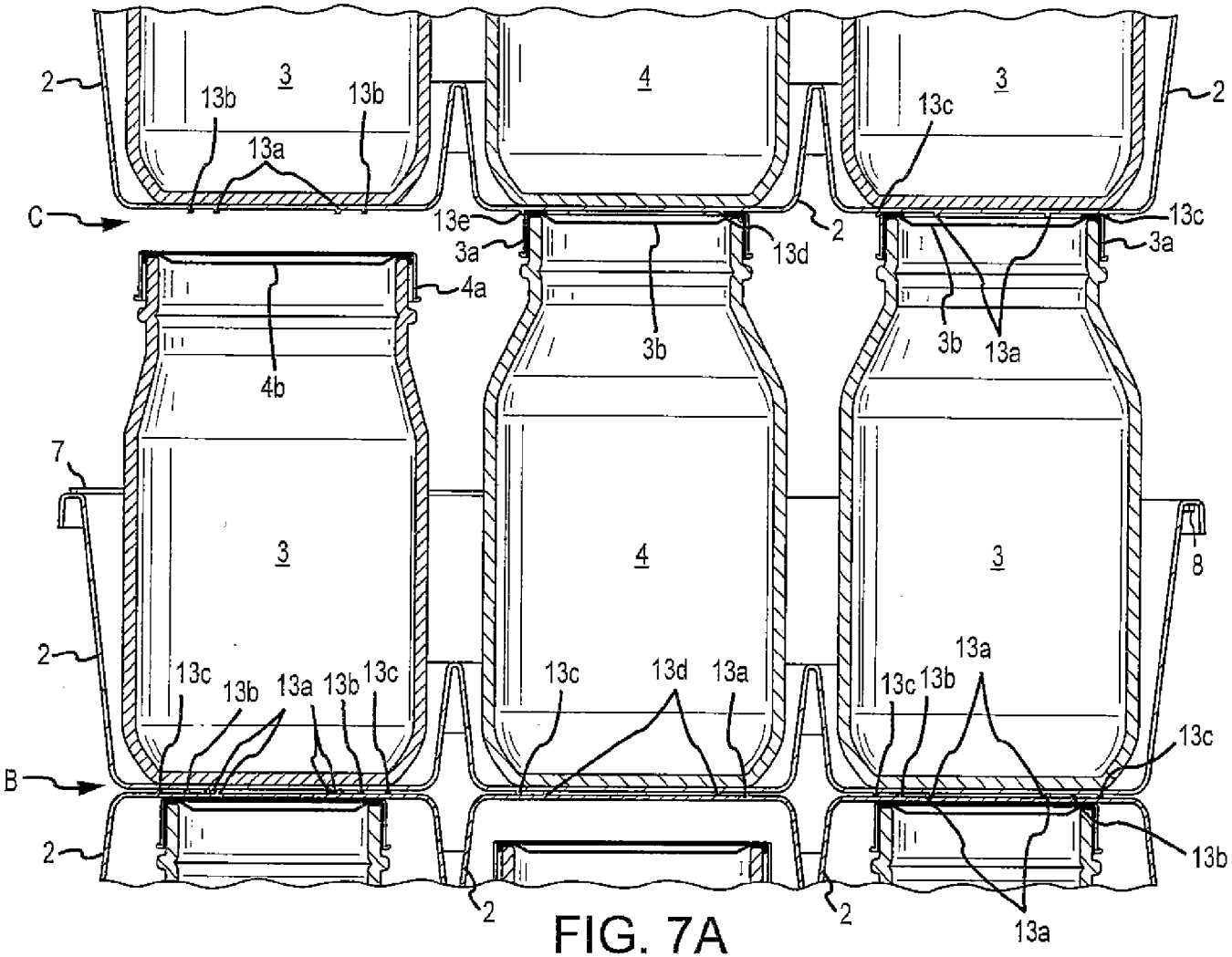
FIG. 7A is a section view of the embodiment shown in FIG. 1 but with the jars in a different position in the tray.

FIG. 7A is the same as FIG. 7 except that the position of the jars has been reversed (i.e., the wide-mouth canning jar 4 is in the middle position in FIG. 7, and the standard canning jar 3 is in the middle position in FIG. 7A). Both FIGS. 7 and 7A show how the ridges 13 on the bottom surfaces of the wells 2 help "locate" the jars relative to the outer rings 3*a*, 4*a* of the lids.

Figure 8:
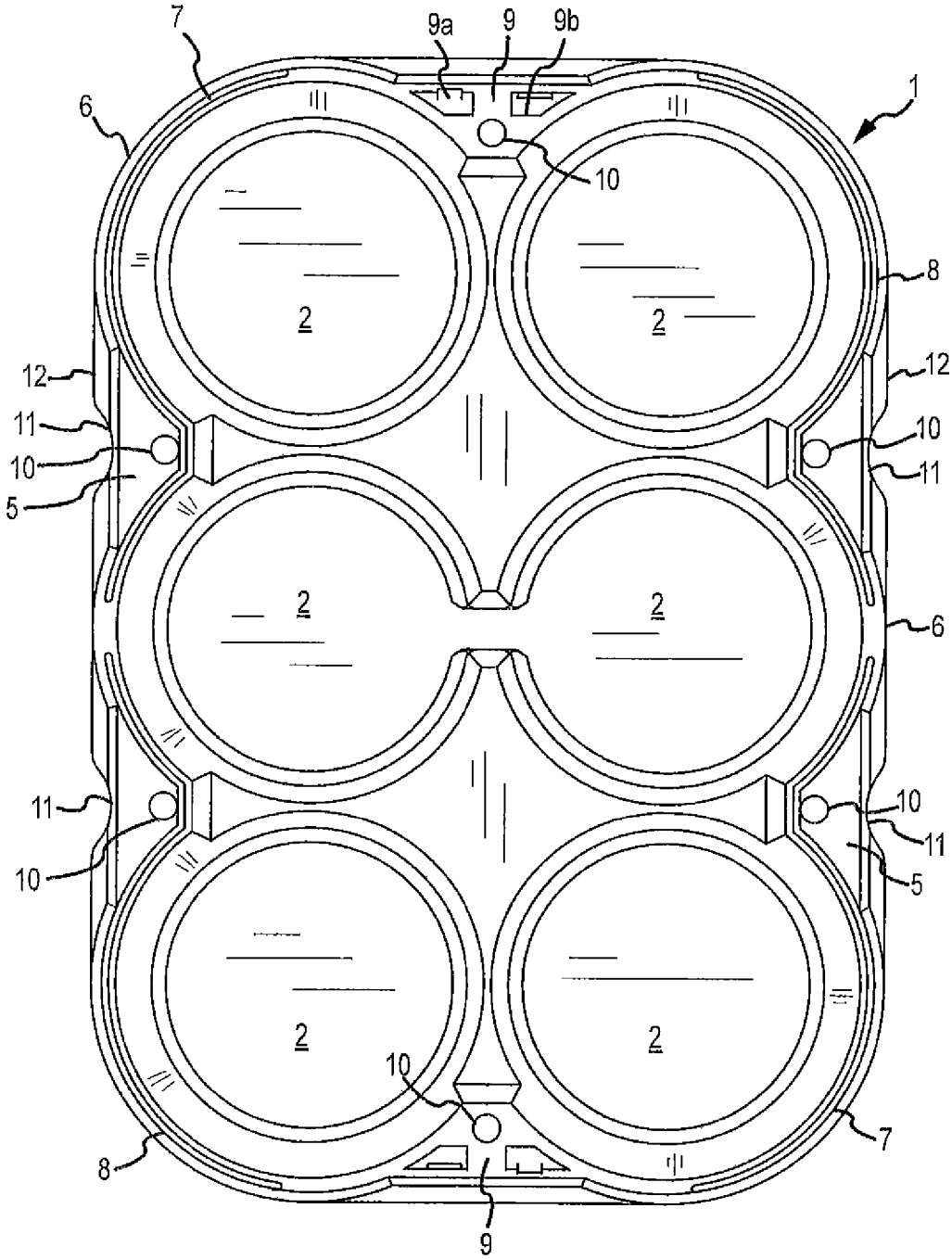
FIG. 8 is a top view of a stacking tray of the first embodiment.

FIG. 8 is a top view of a stacking tray of the first embodiment. This figure shows more clearly the tongues 7 and grooves 8 on the perimeter 6 of the top surface 5 of each tray. It also shows the apertures 10, indentations 11 in the side walls 12, and snap mechanisms 9. Note that the wells 2 are preferably aligned so that they form three rows of two wells each.

Figure 9:
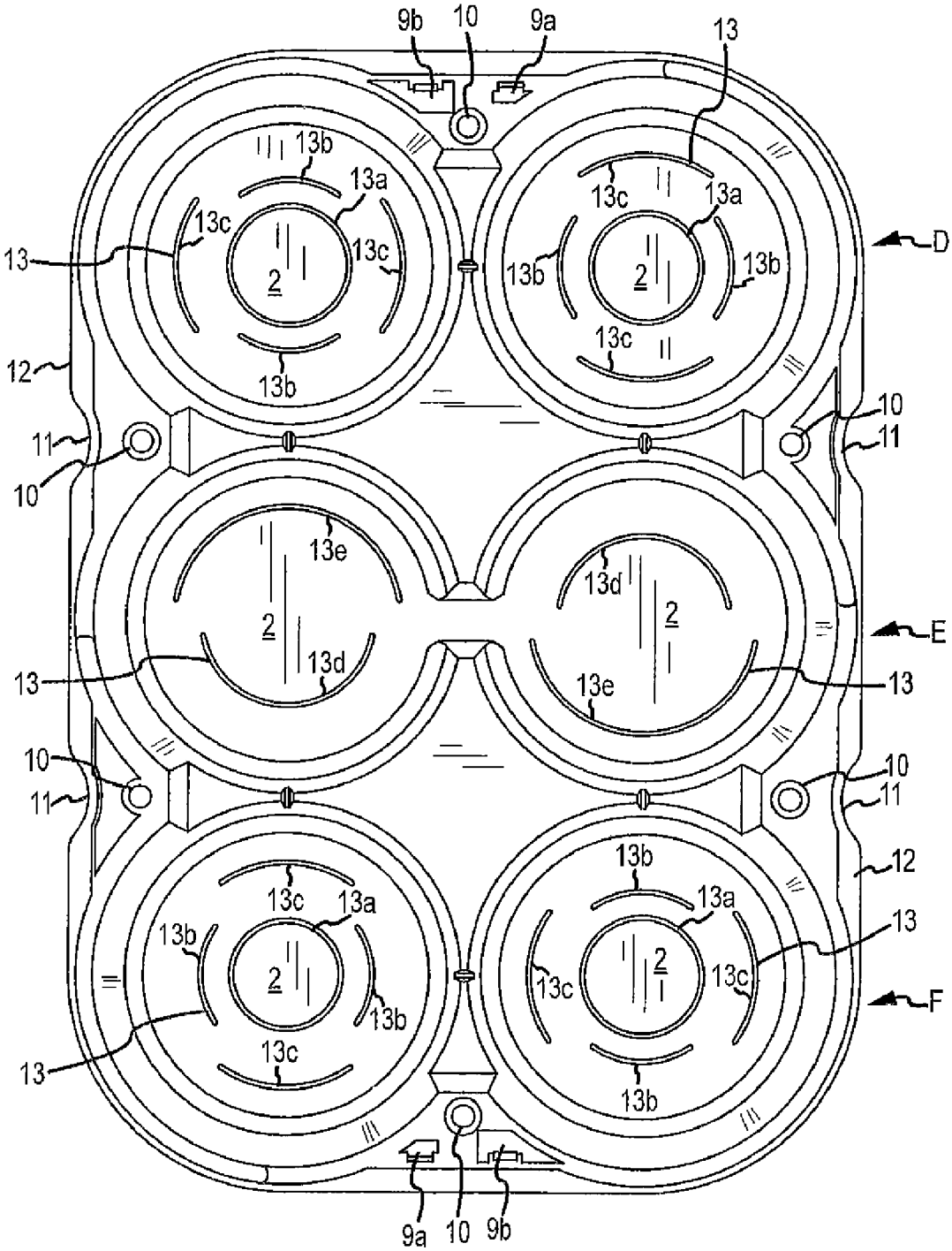
FIG. 9 is a bottom view of a stacking tray of the second embodiment.

FIG. 9 is a bottom view of a stacking tray of the second embodiment. This figure shows the array of ridges 13 on the bottom of each well 2. In a preferred embodiment, the ridges 13 on each well 2 in the first row ("D" on FIG. 9) comprise an inner circle 13*a*, two first opposing partial crescents 13*b* surrounding the circle 13*a*, and two second opposing partial crescents 13*e* at ninety-degree angles to the first partial crescents 13*b*. The two crescents 13*b* are equidistant from the center point of the inner circle 13*a*, as are the two crescents 13*c*, but the two crescents 13*c* are at a greater distance form the center point of the inner circle 13*a* than the two crescents 13*b*. The inner circle 13*a* on the right-hand well 2 is preferably slightly smaller in diameter than the inner circle 13*a* on the left-hand well 2, and the crescents 13*b*, 13*c* on the right-hand well 2 are rotated ninety degrees (90°) relative to the crescents 13*b*, 13*c* on the left-hand well 2 so that when the trays 1 are stacked on top of one another in a bottom-to-bottom configuration, the ridges 13 will not overlap one another.

In a preferred embodiment, each of the two wells 2 that form the second (or center) row ("E" on FIG. 9) comprises ridges 13 in the shape of two opposing semicircles 13*d*, 13*e*, one of which is greater in diameter (relative to the center point of the well) than the other. The semicircles 13*d*, 13*e* on the right-hand well 2 are rotated one hundred eighty (180°) relative to the semicircles 13*d*, 13*e* on the left-hand well 2 so that when the trays 1 are stacked on top of one another in a bottom-to-bottom configuration, the ridges 13 will not overlap one another.

In a preferred embodiment, the wells 2 in the third row ("F" on FIG. 9) comprise ridges 13 configured similarly to those of the wells 2 in the first row, except that the inner circle 13*a* on the left-hand well 2 is preferably slightly smaller than the inner circle 13*a* on the right-hand well 2, and the left-hand well 2 in the third row is rotated ninety degrees (90°) relative to the left-hand well 2 in the first row (and also relative to the right-hand well 2 in the third row), and the right-hand well 2 in the third row is rotated ninety degrees (90°) relative to the right-hand well 2 in the first row (and also relative to the left-hand well 2 in the third row). With the configuration of ridges described above and shown in FIG. 9, trays can be stacked bottom to bottom without the ridges overlapping.

Furthermore, in a preferred embodiment, the outside diameter of the semicircle 13*d* of the wells 2 in the second row is roughly the same as the inside diameter of the outer ring 3*a* on a standard canning jar 3. Similarly, the outside diameter of the semicircle 13*e* of the wells 2 in the second row is roughly the same as the inside diameter of the outer ring 4*a* on a wide-mouth canning jar 4. (As noted above and shown in FIGS. 6 and 7, if both standard 3 and wide-mouth 4 jars are placed in the same tray, then the lid of the wide-mouth jar 4 will not come into contact with the ridges 13 on the bottom of the upper tray.)

In a preferred embodiment, the outside diameter of the inner circles 13*a* on the wells 2 is less than the inside diameter of the outer ring 3*a* on a standard canning jar 3. The crescents 13*b* are roughly the same distance from the center of the inner circle 13*a* on a well 2 as the inner radius of the outer ring 3*a* (i.e., radius to the inside of the outer ring 3*a*) on a standard canning jar 3; thus, when a standard canning jar 3 is placed directly underneath and centered on the bottom of a well 2, the crescents 13*b* will lie just inside the outer ring 3*a* (see FIGS. 7 and 7A). The crescents 13*c* are roughly the same distance from the center of the inner circle 13*a* on a well 2 as the inner radius of the outer ring 4*a* (i.e., radius to the inside of the outer ring 4*a*) on a wide-mouth canning jar 4; thus, when a wide-mouth canning jar 4 is placed directly underneath and centered on the bottom of a well 2, the crescents 13*c* will lie just inside the outer ring 4*a* (see FIGS. 7 and 7A).

With the configuration of ridges 13 described above, the trays 1 may be placed on top of any combination of standard or wide-mouth canning jars (or all standard or all wide-mouth canning jars in a given tray), and the ridges 13 may be used to "locate" the jars (more specifically, the tops of the jars in the bottom tray) on the bottom of the upper tray. Note that the ridges 13 are used primarily to "locate" the insides of the outer rings 3*a*, 4*a* on a canning jar. The purpose of the inner circles 13*a* is primarily to locate the trays when in a bottom-to-bottom configuration.

Figure 10:
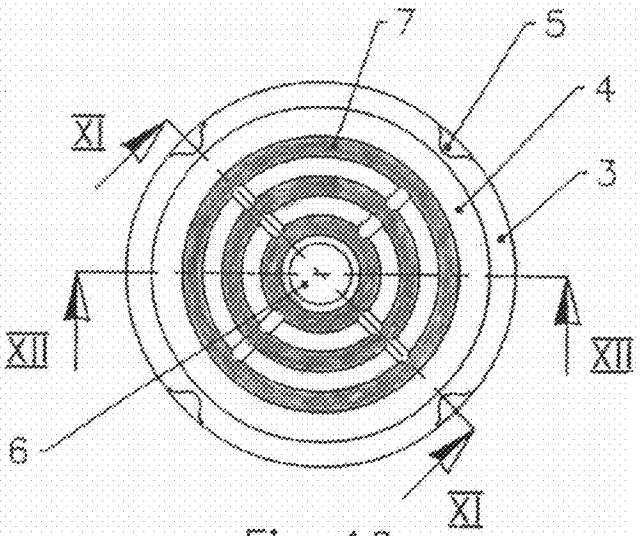
FIG. 10 is a perspective view of a second embodiment of the present invention.
Figure 11:
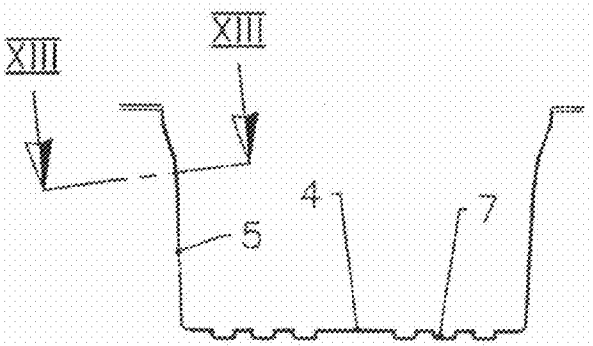
FIG. 11 is an exploded perspective view of a second embodiment of the present invention.

FIG. 10 is a perspective view of a second embodiment of the present invention. This embodiment is similar to the first embodiment except that it comprises twelve wells 2 for canning jars rather than six. FIG. 11 is an exploded perspective view of this embodiment.

Figure 12:
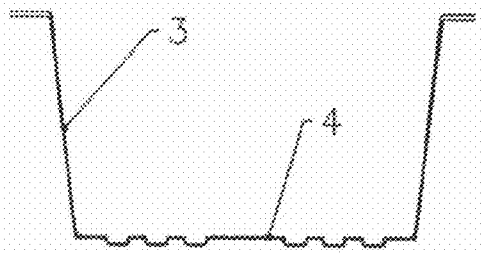
FIG. 12 is a section view of the embodiment shown in FIG. 10.

FIG. 12 is a section view of the embodiment shown in FIG. 10. This figure is similar to FIG. 6 except that the jar sizes (and wells) are smaller.

Figures 13A, 13B, 13C:
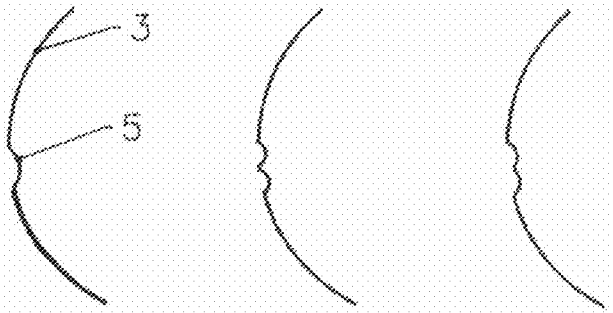
FIG. 13 is a top view of a stacking tray of the second embodiment.

FIG. 13 is a top view of a stacking tray of the second embodiment. This figure is similar to FIG. 8 except that the tray is comprised of three rows of four wells 2 each rather than three rows of two wells 2 each.

Figure 14:
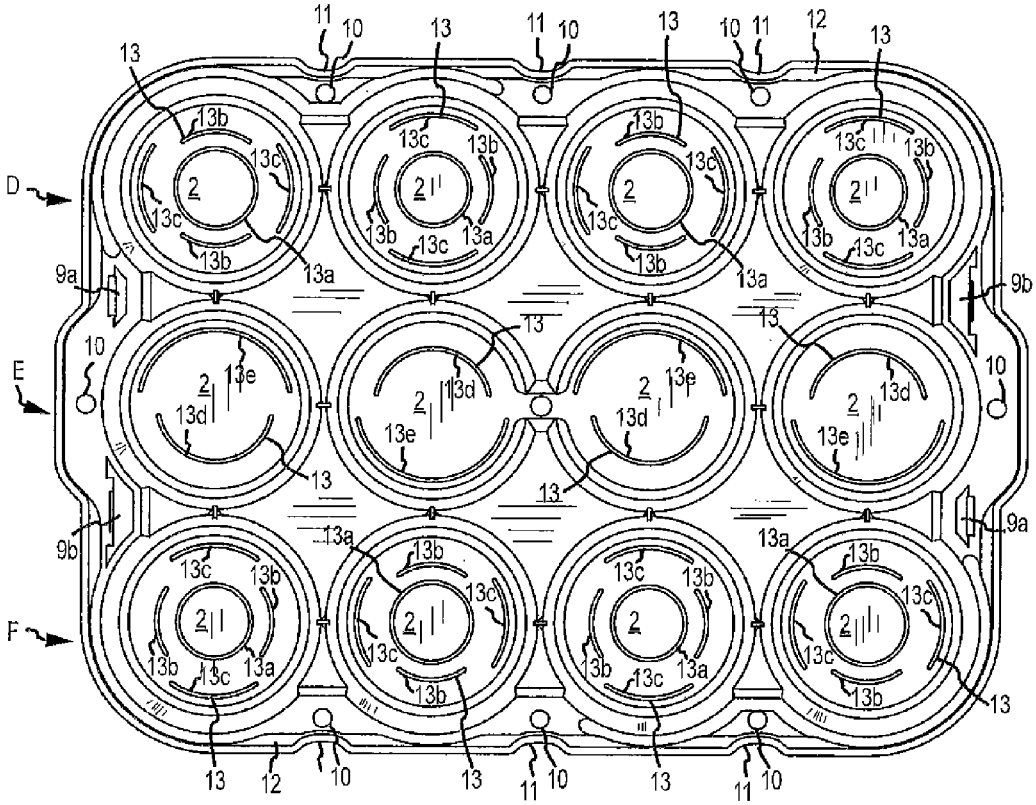
FIG. 14 is a bottom view of a stacking tray of the second embodiment.

FIG. 14 is a bottom view of a stacking tray of the second embodiment. The four wells 2 in the second (or center) row ("E" on FIG. 14) comprise the same set of ridges 13 as in the second row ("E" on FIG. 9) of the first embodiment except that there is twice the number of wells. Similarly, the four wells 2 in the first ("D" on FIG. 14) and third ("F" on FIG. 14) rows comprise the same set of ridges 13 as in the first and third rows ("D" and "F," respectively, on FIG. 9) of the first embodiment except that there is twice the number of wells. Thus, each well in each of the first and third rows is rotated ninety degrees (90°) relative to each of the wells 2 adjacent to it. The right-most well in the first row is rotated ninety degrees (90°) relative to the left-most well in the first row (and also relative to the right-most well in the third row), and the right-most well in the third row is rotated ninety degrees (90°) relative to the left-most well in the third row (and also relative to the right-most well in the first row).

Note that in the first and second embodiments, the distance of the semicircle 13*d* from the center point of the well 2 is roughly the same as the distance of the crescents 13*b* from the center point of the inner circle 13*a*, and the distance of the semicircle 13*e* from the center point of the well 2 is roughly the same as the distance of the crescents 13*c* from the center point of the inner circle 13*a*. As shown in FIG. 14, the inner circles 13*a* of the second and fourth wells in the first row and the inner circles 13*a* of the first and third wells in the third row are slightly smaller in diameter than the inner circles 13*a* of the first and third wells in the first row and the inner circles 13*a* of the second and fourth wells in the third row. As explained above, the reason for this difference in diameter is to prevent the ridges 13 that form the inner circles 13*a* from overlapping when the trays are in a bottom-to-bottom configuration.

The locating and snapping features of the present invention have been described above, and three different stacking configurations (top on top, bottom on bottom, and top of jar on bottom of tray) have been shown and described. Although not shown in any of the figures, the trays 1 may also be nested inside of one another without any jars in them.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A tray for holding canning jars comprising a plurality of wells arranged in a first row, a second row and a third row, each well comprising a bottom surface with ridges that extend downwardly from the bottom surface of the well;

wherein the ridges on the bottom surface of each well in the first and third rows consist of an inner circle, two first opposing crescents that lie outside of the inner circle with a space between each of the two first opposing crescents and the inner circle, and two second opposing crescents, and the ridges on the bottom surface of each well in the second row consist of a first semicircle and a second semicircle;

wherein the inner circle is situated at the center of the bottom surface of each well, the first two opposing crescents are situated opposite one another on the bottom surface of the well, the two second opposing crescents are situated opposite one another on the bottom of the well and at ninety-degree angle relative to the first opposing crescents, and the first opposing crescents are closer to the inner circle than the two second opposing crescents; and wherein the bottom surface of each well has a center, the first semicircle on the bottom surface of the wells in the second row is situated opposite the second semicircle, and the first semicircle is closer to the center of the bottom surface of the well than the second semicircle.

2. The tray of claim 1, wherein each canning jar comprises a lid with an outer ring having an inside diameter, and the outside diameter of the first opposing crescents is roughly the same as the inside diameter of the outer ring of a standard canning jar.

3. The tray of claim 1, wherein each canning jar comprises a lid with an outer ring having an inside diameter, and the outside diameter of the second opposing crescents is roughly the same as inside diameter of the outer ring of a wide-mouth canning jar.

4. The tray of claim 1, wherein each canning jar comprises a lid with an outer ring having an inside diameter, wherein each inner circle has an outside diameter, and wherein the outside diameter of each of the inner circles is less than the inside diameter of the outer ring on the lid of a standard canning jar.

5. The tray of claim 1, wherein each canning jar comprises a lid with an outer ring having an inside diameter, wherein each of the first semicircles has an outside diameter, and wherein the outside diameter of the first semicircles is roughly the same as the inside diameter of the outer ring on the lid of a standard canning jar.

6. The tray of claim 1, wherein each canning jar comprises a lid with an outer ring having an inside diameter, wherein each of the second semicircles has an outside diameter, and wherein the outside diameter of the second semicircle is roughly the same as the inside diameter of the outer ring on the lid of a wide-mouth canning jar.

7. The tray of claim 1, wherein the first and third rows each comprises a first well and a second well, the inner circle on the bottom surface of the second well in the first row is slightly smaller than the inner circle on the bottom surface of the first well in the first row, and the inner circle on the bottom surface of the first well in the third row is slightly smaller than the inner circle on the bottom surface of the second well in the third row.

8. The tray of claim 1, wherein the first and third rows each comprises a first well, a second well, a third well, and a fourth well, the inner circle on the bottom surface of the second and fourth wells in the first row is slightly smaller than the inner circle on the bottom surface of the first and third wells in the first row, and the inner circle on the bottom surface of the first and third wells in the third row is slightly smaller than the inner circle on the bottom surface of the second and fourth wells in the third row.

9. The tray of claim 7, wherein the second well in the first row is rotated ninety degrees relative to the first well in the first row, and the second well in the third row is rotated ninety degrees relative to the first well in the third row and relative to the second well in the first row.

10. The tray of claim 8, wherein the second and fourth wells in the first row are rotated ninety degrees relative to the first and third wells in the first row, and the second and fourth wells in the third row are rotated ninety degrees relative to the first and third row wells in the third row and relative to the second and fourth wells in the first row.

11. The tray of claim 1, wherein the second row comprises a first well and a second well, and wherein the second well in the second row is rotated one hundred eighty degrees relative to the first well in the second row.

12. The tray of claim 1, wherein the second row comprises a first well, a second well, a third well, and a fourth well, and wherein the second and fourth wells in the second row are rotated one hundred eighty degrees relative to the first and third wells in the second row.

13. The tray of claim 1, further comprising a top surface and a perimeter, wherein an equal number of tongues and grooves extend partially around the perimeter of the tray, and the tongues and grooves are situated such that each tongue on one tray fits within a groove on another tray when the top surface of one tray abuts up against the top surface of another tray.

14. The tray of claim 13, wherein the top surface comprises at least one snap mechanism comprised of an upward protrusion and a downward protrusion on the top surface of the tray, and wherein the upward and downward protrusions are situated such that the upward protrusion on one tray fits within a downward protrusion on another tray when the top surface of one tray abuts up against the top surface of another tray.

* * * * *